US005139113A

United States Patent [19]

Mizuno et al.

[11] Patent Number: 5,139,113

[45] Date of Patent: Aug. 18, 1992

[54] APPARATUS FOR DETECTING ABNORMALITIES IN ELEVATOR MOTION

[75] Inventors: Masamoto Mizuno; Terumi Hirabayashi; Masanori Tawada; Toshiyuki Kodera, all of Inazawa, Japan

[73] Assignee: Mitsubishi Denki Kabushiki Kaisha, Japan

[21] Appl. No.: 615,148

[22] Filed: Nov. 19, 1990

[30] Foreign Application Priority Data

Nov. 21, 1989 [JP] Japan ..... 1-302615

[51] Int. Cl.[5] ..... B66B 3/00

[52] U.S. Cl. ..... 187/133

[58] Field of Search ..... 187/100, 105, 133; 364/900

[56] References Cited

U.S. PATENT DOCUMENTS

| | | | |
|---|---|---|---|
| 3,973,648 | 8/1976 | Hummert et al. | 187/133 |
| 4,101,007 | 7/1978 | Magee | 187/105 |
| 4,367,810 | 1/1983 | Doane et al. | 187/100 |
| 4,542,479 | 9/1985 | Kamimura et al. | 364/900 |
| 4,930,604 | 6/1990 | Schienda et al. | 187/133 |

FOREIGN PATENT DOCUMENTS 0148000 7/1985 European Pat. Off. .

*Primary Examiner*—A. D. Pellinen
*Assistant Examiner*—Colbert
*Attorney, Agent, or Firm*—Leydig, Voit & Mayer

[57] ABSTRACT

The elevator control apparatus of the present invention comprises a plurality of drive control apparatus that control the driving of various motions of the elevator, a signal mutual transmission device for connecting the plurality of the drive control apparatus and for transmitting signals among them, and a plurality of abnormality judgment devices, disposed on each of the plurality of the drive control apparatus, that monitor the motions of the elevator controlled by the plurality of the drive control apparatus by transmitting sigals among them via the signal mutual transmission device, each one of the plurality of the abnormality judgment devices individually judging the abnormality of the same motion.

3 Claims, 7 Drawing Sheets

APPARATUS FOR DETECTING ABNORMALITIES IN ELEVATOR MOTION

BACKGROUND OF THE INVENTION

1. Field of the Invention

The present invention relates to an elevator control apparatus which controls a motor that allows an elevator to move downward and upward and a motor that allows a door to be opened and closed with a microcomputer.

2. Description of the Related Art

The configuration of a common elevator apparatus is shown in FIG. 5. In FIG. 5, reference numeral 1 denotes a counter weight, 2 denotes a deflector sheave, 3 denotes a traction machine, 6 denotes a motor for moving a car downward and upward, 7 denotes an elevator rope, 8 denotes a door drive control apparatus, 9 denotes an elevator car, 10 denotes an elevator door, and 11 denotes a cable for connecting an elevator drive control apparatus 12, the door drive control apparatus 8, an operation panel inside the car, and lights inside the car, etc. FIG. 6 is a detailed view of the door 10 portion of the elevator. In FIG. 6, reference numeral 13 denotes a motor for opening and closing a door, 14 denotes a pulley for driving a link mechanism 15, 17 denotes a hanger roller for guiding the door 16, 18 denotes a hanger case, and 18A denotes a detection plate for actuating a door completely open detector OLT 18B and a door completely closed detector CLT 18C. In an elevator configured as described above, the elevator drive control apparatus 12 has previously been controlled by a commonly used microcomputer, as described in "Application of VVVF Control to an Elevator" (Mitsubishi Electric Technical Report, Vol. 58, No. 12, 1984, pp 20 to 24). However, the door drive control apparatus 8 is generally formed by an analog circuit. For this reason, connection signals among respective control apparatus are limited. For example, as shown in FIG. 7, at the very most, a door open instruction DOI, a door close instruction DCI, a running (moving downward and upward) signal RU are sent out from the elevator drive control apparatus 12 to the door drive control apparatus 8, and a door completely open signal DOS indicating that a door is open, a door completely closed signal DCS indicating that a door is closed, an emergency door reverse signal EDR indicating that a safety device for the door has been actuated are sent out from the door drive control apparatus 8 to the elevator drive control apparatus 12. In FIG. 7, reference numeral 6A denotes an encoder for detecting the speed of the elevator motor 6 and the position of the car 9, 13A denotes an encoder for detecting the speed of a motor 13 for driving a door and the position of the door. In such an elevator system, checking of an abnormality of the door drive control apparatus 8 is performed simply, in such a way that time period Tc, from the time a door close instruction DCI from the elevator drive control apparatus 12 to the door drive control apparatus 8 is output to the time a door completely closed signal DCS is sent back, is checked, or time period $T_0$, from when a door open instruction DOI is output to when a door completely open signal DOS is sent back, is checked. The abnormality is detected and processed by the elevator drive control apparatus 12 based on the above check.

In the above-described conventional elevator control apparatus, since the door drive control apparatus 8 is not equipped with a means for checking a door open/close abnormality, the checking of an abnormality related to a door can be performed only by the elevator drive control apparatus 12. For this reason, when the check mechanism of the elevator drive control apparatus 12 is abnormal, the restart sequence of the door open/close for itself will be performed by the abnormal elevator drive control apparatus 12 itself. As a result, there is a mode in which it is difficult to operate the restart sequence normally, or there exists a problem in that the safety check cannot be performed for the whole elevator control apparatus.

SUMMARY OF THE INVENTION

The present invention has been devised to solve the above mentioned problems. An object of the present invention is to provide an elevator control apparatus which monitors an abnormality from among a plurality of drive control apparatus, such as a door drive control apparatus and an elevator drive control apparatus, and which is capable of restarting drive control for an abnormal drive control apparatus by another drive control apparatus when an abnormality is detected in any one of the drive control apparatus.

The elevator control apparatus of the present invention comprises a plurality of drive control apparatus that control the driving of various motions of the elevator; a signal mutual transmission device for connecting the plurality of the drive control apparatus and for transmitting signals among them; and a plurality of abnormality judgment devices, disposed on each of the plurality of the drive control apparatus, that monitor the motions of the elevator controlled by the plurality of the drive control apparatus by transmitting signals among them via the signal mutual transmission device, each one of the plurality of the abnormality judgment devices individually judging the abnormality of the same motion.

DESCRIPTION OF THE PREFERRED EMBODIMENTS

The embodiments of the present invention will be explained hereinunder with reference to the accompanying drawings.

Figure 1:
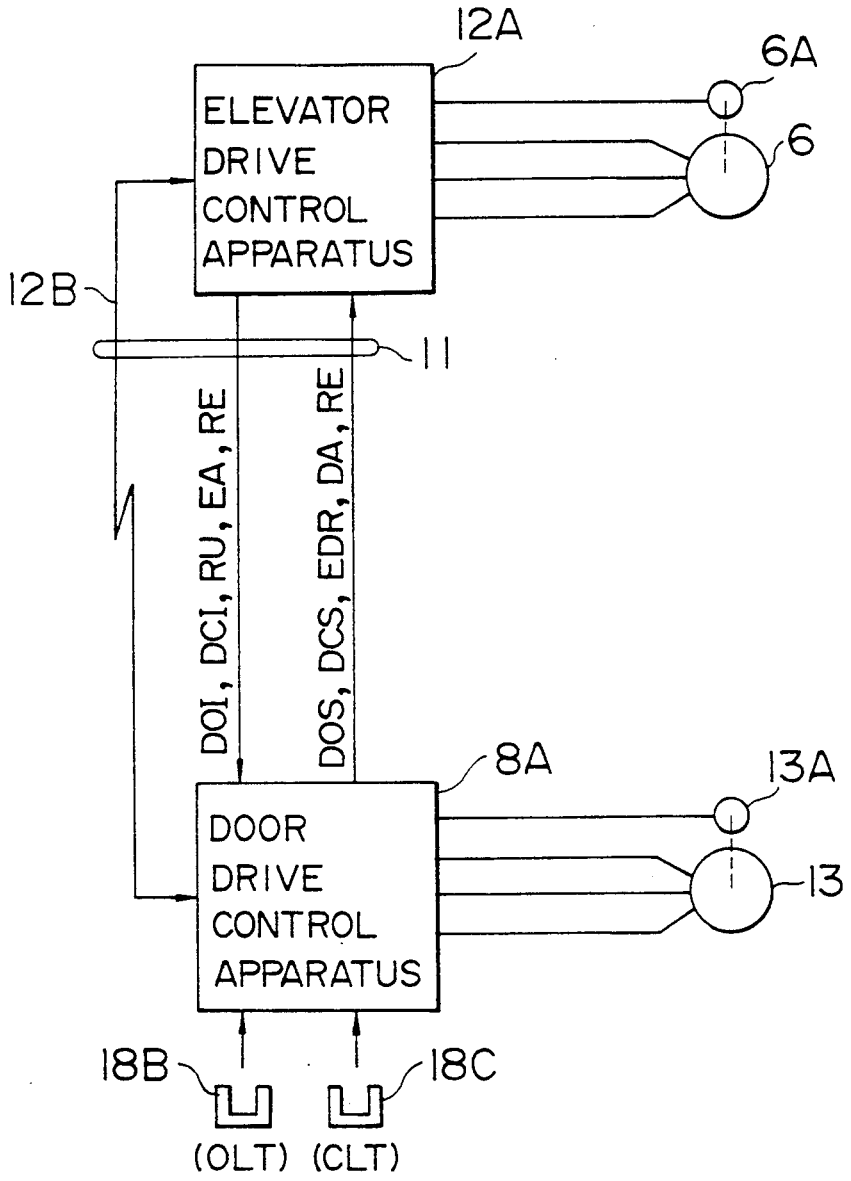
FIG. 1 is a block diagram showing the elevator control apparatus according to an embodiment of the present invention.

In FIG. 1, an elevator drive control apparatus 12A is connected to a motor 6 for moving a car downward and upward and an encoder 6A, while a door drive control apparatus 8A is connected to a motor 13 for opening/closing a door and an encoder 13A. The elevator drive control apparatus 12A and the door drive control apparatus 8A are connected to each other via a cable 11. A door completely open detector 18B and a door completely closed detector 18C are connected to the door drive control apparatus 8A.

From the elevator drive control apparatus 12A, an elevator abnormal signal EA, a reset signal RE in addition to a door open instruction DOI, a door close instruction DCI, and a running signal RU are output to the door drive control apparatus 8A. From the door drive control apparatus 8A, a door abnormal signal DA, a reset signal RE in addition to the door completely open signal DOS, the door completely closed signal DCS, and the emergency door reverse signal EDR are output to the elevator drive control apparatus 12A. The reset signal RE output from the elevator drive control apparatus 12A is used to restart the door drive control apparatus 8A after an abnormality checking operation for the door drive control apparatus 8A is terminated. Conversely, the reset signal RE output from the door drive control apparatus 8A is used to restart the elevator drive control apparatus 12A after an abnormality checking operation for the elevator drive control apparatus 12A is terminated.

In FIG. 1, reference numeral 12B denotes a serial transmission line for serially exchanging information between the elevator drive control apparatus 12A and the door drive control apparatus 8A via the cable 11. The provision of such a serial transmission line 12B allows a detailed mutual abnormality monitoring without increasing the number of cables.

Figure 2:
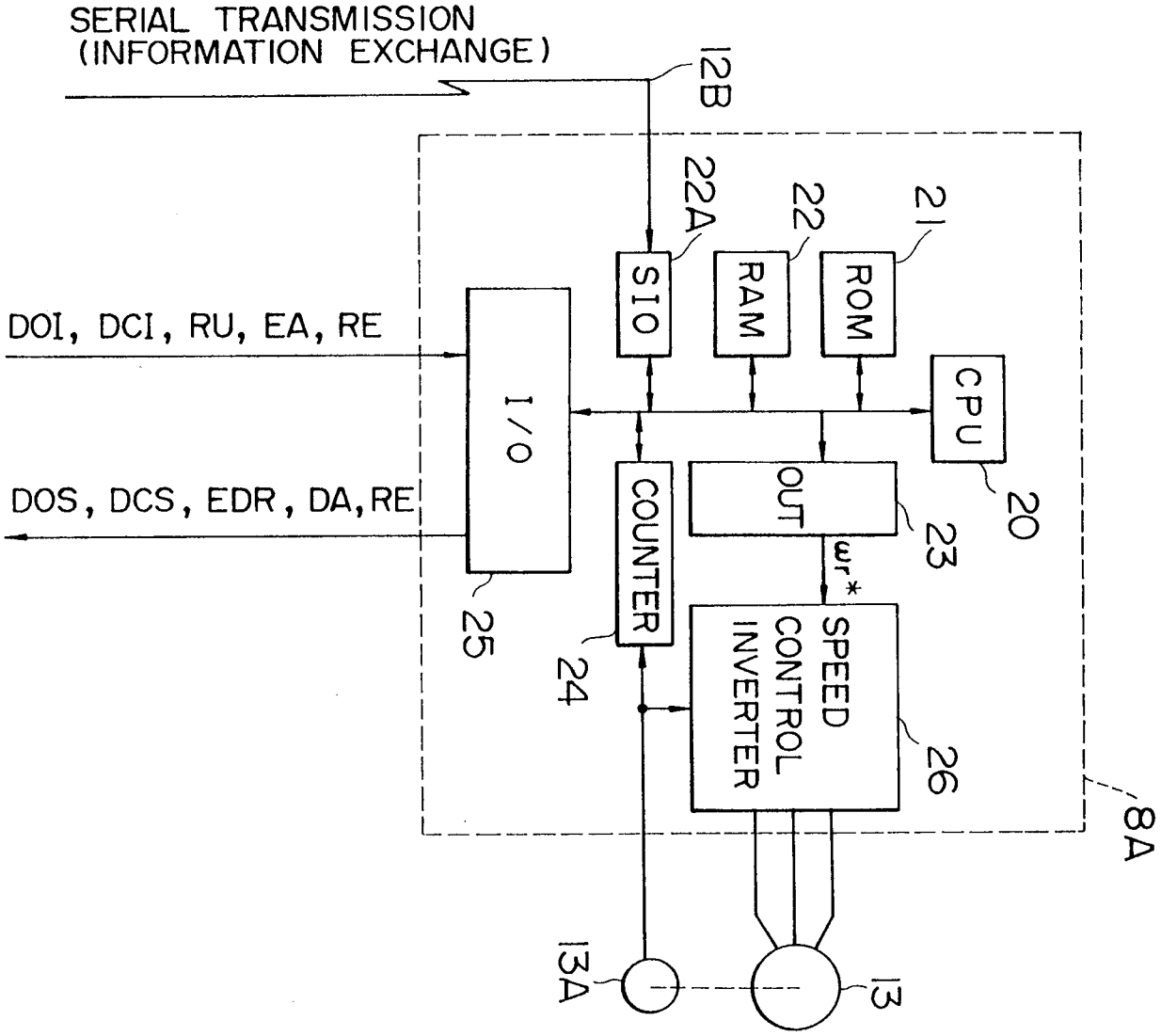
FIG. 2 is a block diagram showing the internal arrangement of the door drive control apparatus in FIG. 1.
Figure 6:
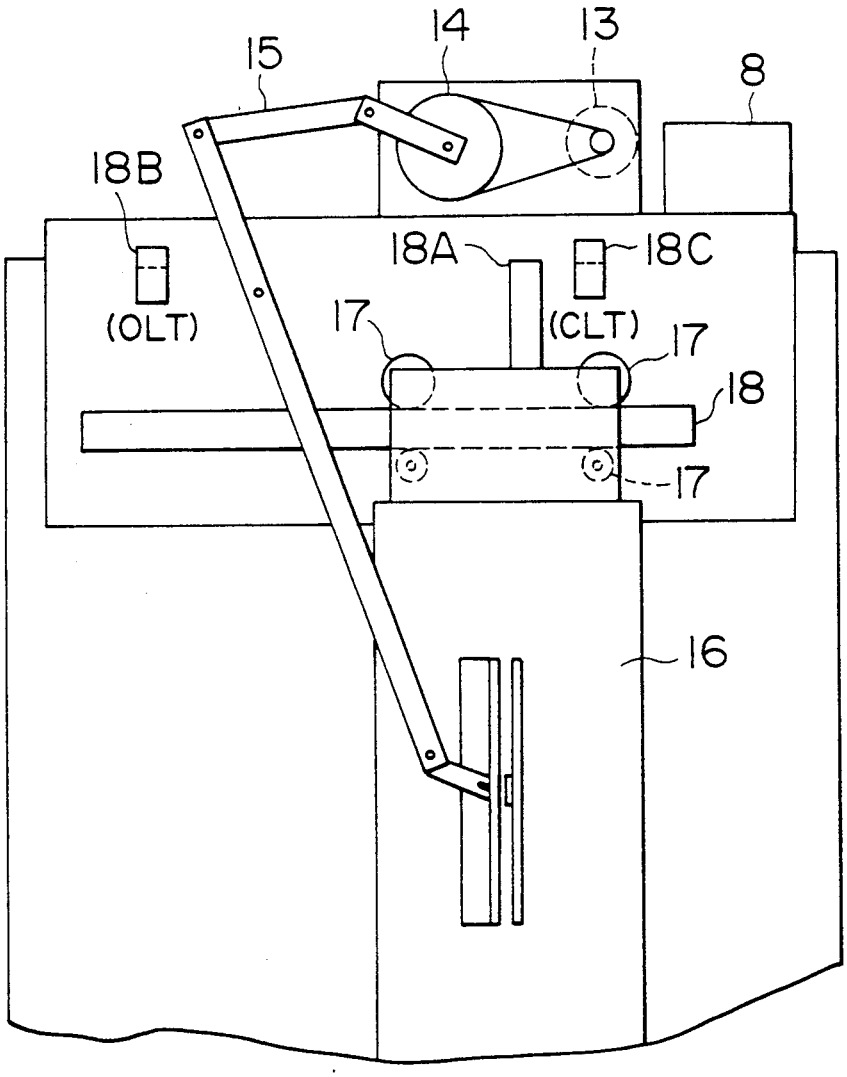
FIG. 6 PRIOR ART
FIG. 6 is an enlarged view showing the door portion of the car in FIG. 5.
Figure 7:
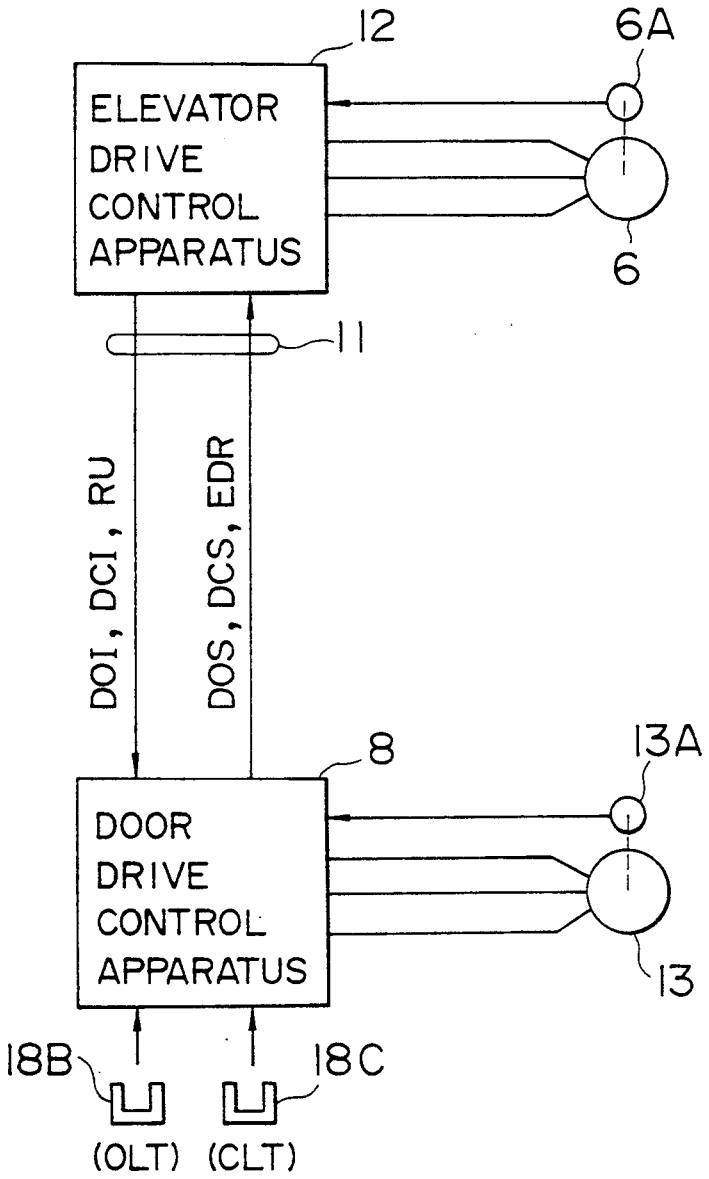
FIG. 7 PRIOR ART
FIG. 7 is a block diagram showing a conventional elevator control apparatus.

FIG. 2 shows the internal arrangement of the door drive control apparatus 8A. This door drive control apparatus 8A performs an abnormality checking operation of the same as that by the elevator drive control apparatus 12A, monitors and judges the abnormality checking performed by the elevator drive control apparatus 12A, and outputs a reset signal RE for restarting an abnormality checking to the elevator drive control apparatus 12A when an elevator abnormal signal EA is input from the elevator drive control apparatus 12A. In FIG. 2, reference numeral 20 denotes a CPU, 21 denotes a ROM in which programs are stored, 22 denotes a RAM in which data is stored, 22A denotes a serial transmission interface (SIO) used to exchange information with the elevator drive control apparatus 12A, 23 denotes an output circuit that outputs a speed instruction $\omega_r$* for the motor 13, 24 denotes a counter for counting the position of the door, 25 denotes an I/O unit for inputting and outputting signals to and from the elevator drive control apparatus 12A, and 26 denotes a speed control inverter for performing digital speed control. The operating principle of the speed control inverter is not directly related to the present invention, thus an explanation thereof is omitted. It is, however, described in detail, e.g., in FIG. 6.44 "Microcomputerized Vector Control", page 213, "New Drive Electronics" edited by Naohiko Ueda and published by Denkishoin. A dual safety check is realized by the door drive control apparatus 8A configured as above along with the elevator drive control apparatus 12A.

Figure 3:
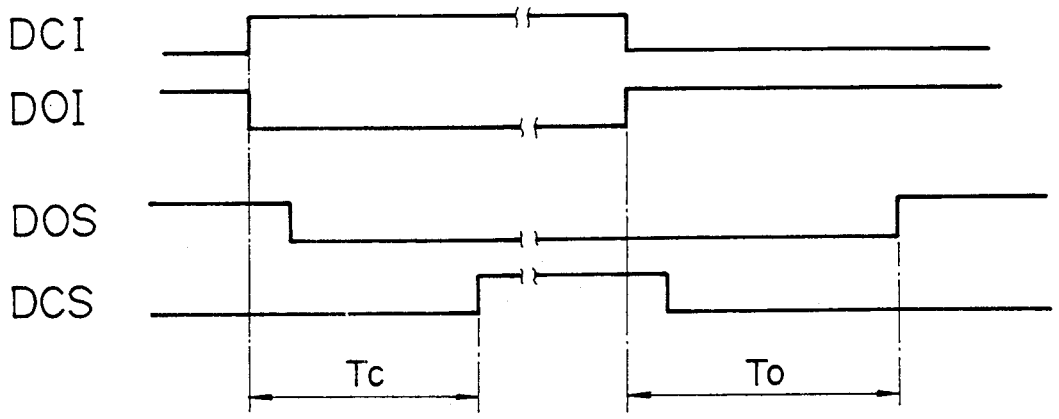
FIG. 3 is a timechart for each of the signals in the embodiment.

As an example of such a dual safety check, a door open check will now be described. In the elevator drive control apparatus 12A, first, a time period $T_0$ (See FIG. 3) from the time a door open instruction DOI is output to the door drive control apparatus 8A to the time a door completely open signal DOS is sent back is measured. On the basis of this elapsed time $T_0$ or the input of the door completely open signal DOS, the completion of motion that the door is open is checked. This check result is sent out to the door drive control apparatus 8A.

Figure 4:
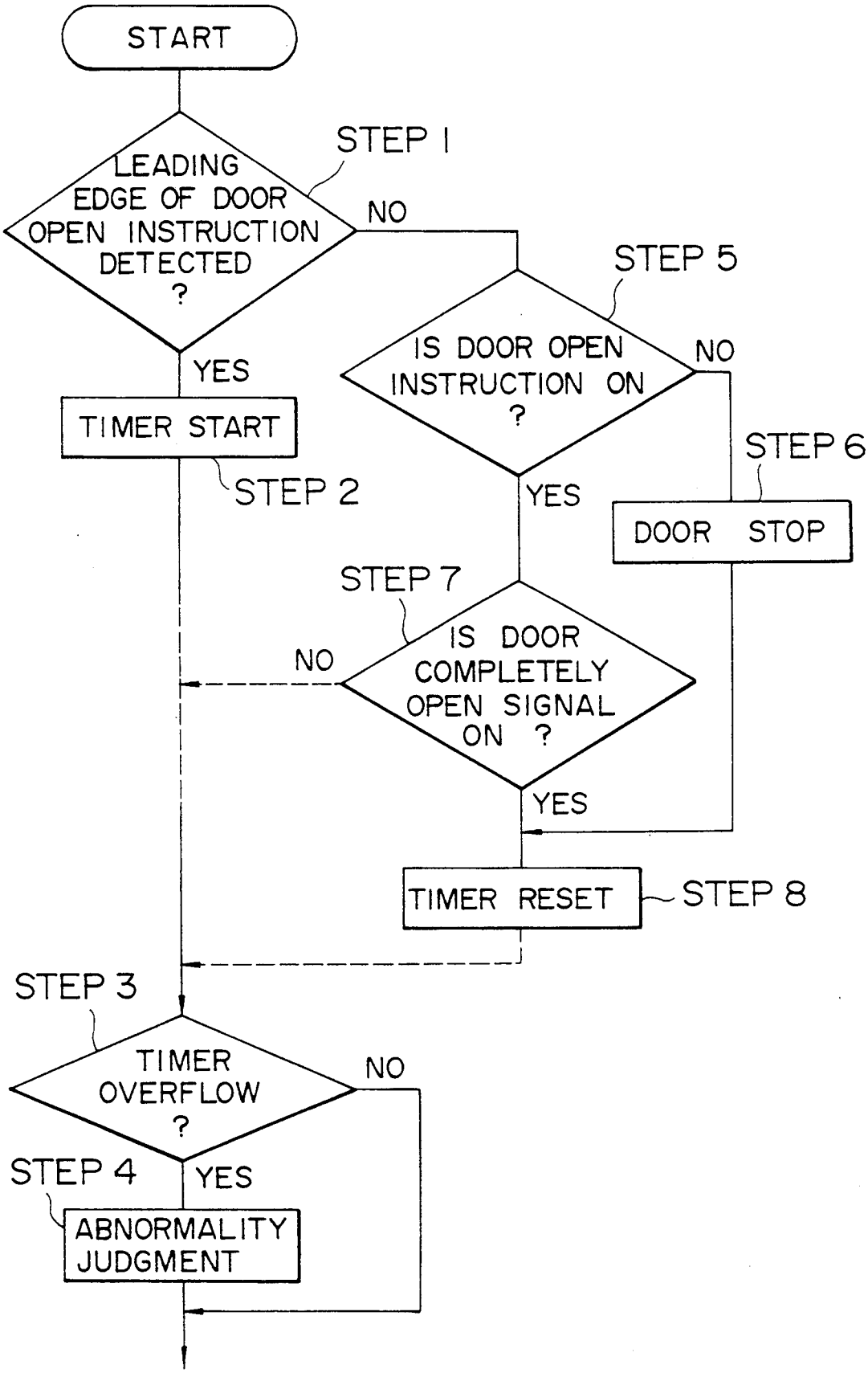
FIG. 4 is a flowchart showing the operation of the embodiment.

Meanwhile, when the door drive control apparatus 8A detects the leading edge of the door open instruction DOI in step 1, as shown in the flowchart of FIG. 4, the door drive control apparatus 8A starts a door opening operation and causes the timer to start in order to measure the lapse of time until the opening operation is completed in step 2. In step 3, whether or not the door completely open signal DOE has been input until a predetermined time has been elapsed is determined. If it is judged to be a timeover, it is judged in step 4 to be an abnormal door opening. At this time, a judgment signal corresponding to the abnormal or normal door opening is output to the elevator drive control apparatus 12A.

When the leading edge of the door open instruction DOI is not detected in step 1, the process proceeds to step 5 in which it is determined whether or not the door open instruction DOI from the elevator drive control apparatus 12A to the door drive control apparatus 8A is on. If it is on, whether or not the door completely open signal DOS is on is determined in step 7. If it is on, the timer is reset in step 8; if still off, the checking of the timer time continues.

However, if it is determined that the door open instruction DOI is off in step 5, the door drive control apparatus 8A determines that the door is being closed or is in a stopped state, and performs a door stopping operation in step 6.

That is, if the door reaches the door completely open state before the timer overflows after the door open instruction DOI is turned on, the timer is reset. If the timer overflows before the door reaches the door completely open state, it is judged to be an abnormal door opening.

If an abnormal door opening is detected in the door drive control apparatus 8A in the above way, a door abnormal signal DA is output to the elevator drive control apparatus 12A. If the elevator drive control apparatus 12A receives this signal, it judges the details of the abnormality's contents, such as an abnormal door-open timer, through the serial transmission line 12B, and outputs a reset signal RE to the door drive control apparatus 8A as a restart signal for the door drive control apparatus 8A. Conversely, if an abnormal door opening is detected in the elevator drive control apparatus 12A, whether or not a door abnormal signal DA has been input from the door drive control apparatus 8A is determined. If it has been input, a reset signal RE is output to the door drive control apparatus 8A as a restart signal for the door drive control apparatus 8A in the same way as described above. If the door abnormal signal DA has not been input, the contents of the door drive control apparatus 8A are checked through the serial transmission line 12B. If they are judged to be normal, the abnormal door opening detection circuit on the elevator drive control apparatus 12A side is judged to be abnormal, and the reset signal RE is not output to the door drive control apparatus 8A. If it is judged that the door drive control apparatus 8A is abnormal, the reset signal RE is output to the door drive control apparatus 8A as a restart signal for the door drive control apparatus 8A.

That is, the same door-open motion check is performed by both the control apparatus 8A and 12A. If a normal door opening is determined in one of the control apparatus and an abnormal door opening is determined in the other control apparatus, the control apparatus that has received a judgment signal of an abnormal door opening outputs a reset signal for rechecking a door opening motion to the control apparatus that has judged the abnormality.

As described above, the use of a microcomputer in a door drive control apparatus enables software to easily perform a door safety check. In addition, since the safety check of the whole elevator control apparatus is performed by both the elevator drive control apparatus and the door drive control apparatus, a double safety check can be made easily, and thus the reliability is improved.

If the details of the control status of each of the above control apparatus are transmitted to each other by serial signals by a commonly used RS232C format, etc., a close monitoring of an abnormality is possible without increasing the number of cables. Thus, the reliability of the control apparatus is further improved.

Figure 5:
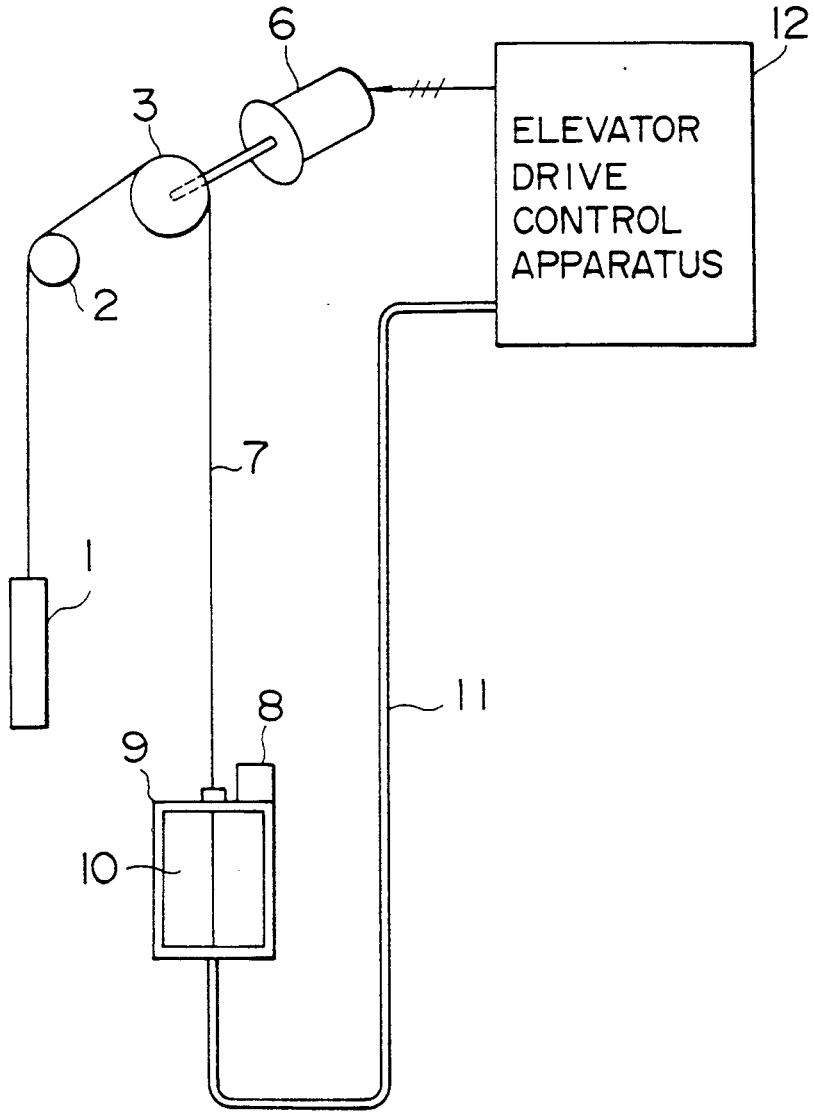
FIG. 5 PRIOR ART
FIG. 5 is a view showing the apparatus arrangement of a commonly used elevator.

In FIG. 5, a proximity switch (not shown) is usually disposed on the car 9. The output of this switch is sent to the elevator drive control apparatus 12 via the cable 11. On the basis of this output, the elevator drive control apparatus 12 detects that the car 9 has stopped in a predetermined position and outputs a door open instruction DOI to the door drive control apparatus 8. Consequently, in this embodiment, whether an abnormal car position, such as the car 9 has output the door open instruction DOI at a position which is not predetermined, is judged, by monitoring the output from the proximity switch also with the door drive control apparatus 8A.

In addition, by monitoring a running signal RU and a door open instruction DOI from the elevator drive control apparatus 12A with the door drive control apparatus 8A also, a malfunction of the elevator drive control apparatus 12A can be monitored. In addition, a mode in which a door becomes open while a car is running, which is very dangerous, can be double checked.

As has been explained above, in the present invention, since an elevator abnormal signal EA is output from the elevator drive control apparatus 12A to the door drive control apparatus 8A, and a door abnormal signal DA is output from the door drive control apparatus 8A to the elevator drive control apparatus 12A, a mutual monitoring of an abnormality is possible.

Further, in the above-described embodiment, a door-open time check is monitored by both the elevator drive control apparatus 12A and the door drive control apparatus 8A. However, one of the control apparatus separately may monitor an abnormality, for example, an over current of the elevator drive control apparatus 12A. When an abnormality occurs, an abnormality signal is output to the other control apparatus, and this one of the control apparatus can be reset by the other control apparatus.

What is claimed is:

1. An elevator control apparatus, comprising:

an elevator drive control apparatus that controls the driving of the downward and upward movement of a car;

a door drive control apparatus that controls the driving of the opening/closing of a door of the car on the basis of a signal from said elevator drive control apparatus; and a pair of individual abnormality judgment means, one disposed in said elevator drive control apparatus and one disposed in said door drive control apparatus, both of said abnormality judgment means monitoring the door opening/closing motion by said door drive control apparatus on the basis of values of door opening/closing time operating independently to provide a dual safety check of the operation of the door drive control apparatus, and including means for independently resetting the individual abnormality judgment means.

2. An apparatus according to claim 1 wherein the abnormality judgment means are controlled by programs, and the programs include a door open instruction DOI and a door close instruction DCI which are sent from the elevator drive control apparatus to the door drive control apparatus, wherein the apparatus includes means which generate a door completely open signal DOS and a door completely closed signal DCS responsive to the position of the door, and wherein the elevator drive control apparatus and the door drive control apparatus both include means which measure elapsed $T_0$ between DOI and DOS and elapsed $T_C$ between DCI and DCS and compare the elapsed $T_0$ and $T_C$ with predetermined times to base an abnormality judgment determination.

3. An elevator control apparatus comprising:

an elevator drive control device which generates elevator door instruction signals;

an elevator door drive control device which receives elevator door instruction signals from said elevator drive control device and generates signals indicative of the position of an elevator door;

a transmission line connecting said elevator door drive control device and said elevator drive control device which transmits information signals between said devices;

a first abnormality detection devices disposed in said elevator door drive control device which generates abnormality signals when an elevator door is not completely opened before a predetermined time has elapsed;

a second abnormality detection device disposed in said elevator drive control device which operates independently from said first abnormality detection device and generates an abnormality signal when an elevator door is not completely opened before a predetermined time has elapsed;

said elevator drive control device including means for transmitting a reset signal to said elevator door drive control device, said means being responsive to an abnormality signal generated by said first abnormality detection device, and further generating a reset signal responsive to contents of the information signal of said transmission line.

* * * * *